US008221073B2

(12) United States Patent
Macfarlane et al.

(10) Patent No.: US 8,221,073 B2
(45) Date of Patent: Jul. 17, 2012

(54) EXHAUST GAS DISCHARGE SYSTEM AND PLENUM

(75) Inventors: Ian Macfarlane, St. Bruno (CA); Zenon Szlanta, Brossard (CA)

(73) Assignee: Pratt & Whitney Canada Corp., Longueuil (CA)

( * ) Notice: Subject to any disclaimer, the term of this patent is extended or adjusted under 35 U.S.C. 154(b) by 730 days.

(21) Appl. No.: 12/341,242

(22) Filed: Dec. 22, 2008

(65) Prior Publication Data

US 2010/0158683 A1 Jun. 24, 2010

(51) Int. Cl.
*F03B 11/02* (2006.01)

(52) U.S. Cl. ..... 415/211.2; 415/226

(58) Field of Classification Search ..... 415/211.2, 415/212.1, 225, 226, 207; 60/770, 771, 767; 417/509, 522

See application file for complete search history.

(56) References Cited

U.S. PATENT DOCUMENTS 3,054,257 A 9/1962 Schelp
3,299,632 A 1/1967 Wilde et al.
3,759,627 A 9/1973 Ehlinger
3,856,430 A 12/1974 Langham
4,763,471 A 8/1988 Keller
5,557,918 A 9/1996 Chyou et al.
5,632,142 A * 5/1997 Surette ..... 60/772
5,839,283 A 11/1998 Dobbeling
5,855,112 A 1/1999 Bannai et al.
5,983,643 A 11/1999 Kiesow
6,146,092 A 11/2000 Botros et al.
6,718,769 B2 4/2004 Inoue et al.
6,722,133 B2 4/2004 Inoue et al.
6,886,341 B2 5/2005 Inoue et al.
7,581,400 B2 * 9/2009 Brunet et al. ..... 60/770
2010/0251692 A1 * 10/2010 Kinde, Sr. ..... 60/226.1

* cited by examiner

*Primary Examiner* — Caridad Everhart
(74) *Attorney, Agent, or Firm* — Norton Rose Canada LLP

(57) ABSTRACT

An apparatus for extending the effective exhaust gas path in order to allow gradual diffusion of the exhaust gases in a turboshaft engine wherein the engine includes an annular engine case with at least an exhaust gas duct having an axial component communicating with an annular duct with a substantially radial component and traversing the engine case, the apparatus comprising a collector plenum having a convex annular shape and a diameter larger than that of the engine case with at least one exhaust outlet defined in the plenum and wherein the annular duct extends into the plenum beyond the diameter of the engine case to extend the exhaust gas path.

7 Claims, 5 Drawing Sheets

EXHAUST GAS DISCHARGE SYSTEM AND PLENUM

TECHNICAL FIELD

The application relates generally to gas turbine engines and, more particularly, to a gas turbine engine exhaust system having a change of direction.

BACKGROUND OF THE ART

Whenever a gas turbine exhaust gas flow is forced to change direction, energy losses occur. This is particularly applicable to turboshaft engines.

Accordingly, there is a need to provide a new exhaust gas discharge system particularly in turboshaft engines with a view to minimize energy losses where the exhaust gases are forced to change direction.

SUMMARY

In accordance with a general aspect, there is thus provided a turboshaft engine including an annular engine case with at least an exhaust gas duct having an axial component and a substantially radial component projecting at least partly beyond the engine case to extend the effective exhaust gas path outside of the engine case in order to allow gradual diffusion of the exhaust gases, and a collector plenum with an outlet surrounding the radial component of the exhaust gas duct.

In a second aspect, there is provided an apparatus for extending the effective exhaust gas path in a gas turbine engine of the type having an annular engine case with at least an exhaust gas duct defining a change of flow direction, the apparatus comprising a separable collector plenum having a convex annular shape and a diameter larger than that of the engine case with at least one exhaust outlet defined in a wall of the plenum, and an extended annular duct formed within the plenum beyond the diameter of the engine case to extend the exhaust gas path.

In a third aspect, there is provided a method of diffusing the exhaust gases of a turboshaft gas engine with an annular engine case, including the steps of: passing the exhaust gases through an exhaust duct having an axial component and a radial component, extending the exhaust gas path by projecting the exhaust duct in its radial component beyond the engine casing in order to allow gradual diffusion of the exhaust gases, and collecting the diffused exhaust gases in an annular plenum with an outlet.

DESCRIPTION OF THE DRAWINGS

Reference is now made to the accompanying figures, in which.

DETAILED DESCRIPTION

Figure 1:
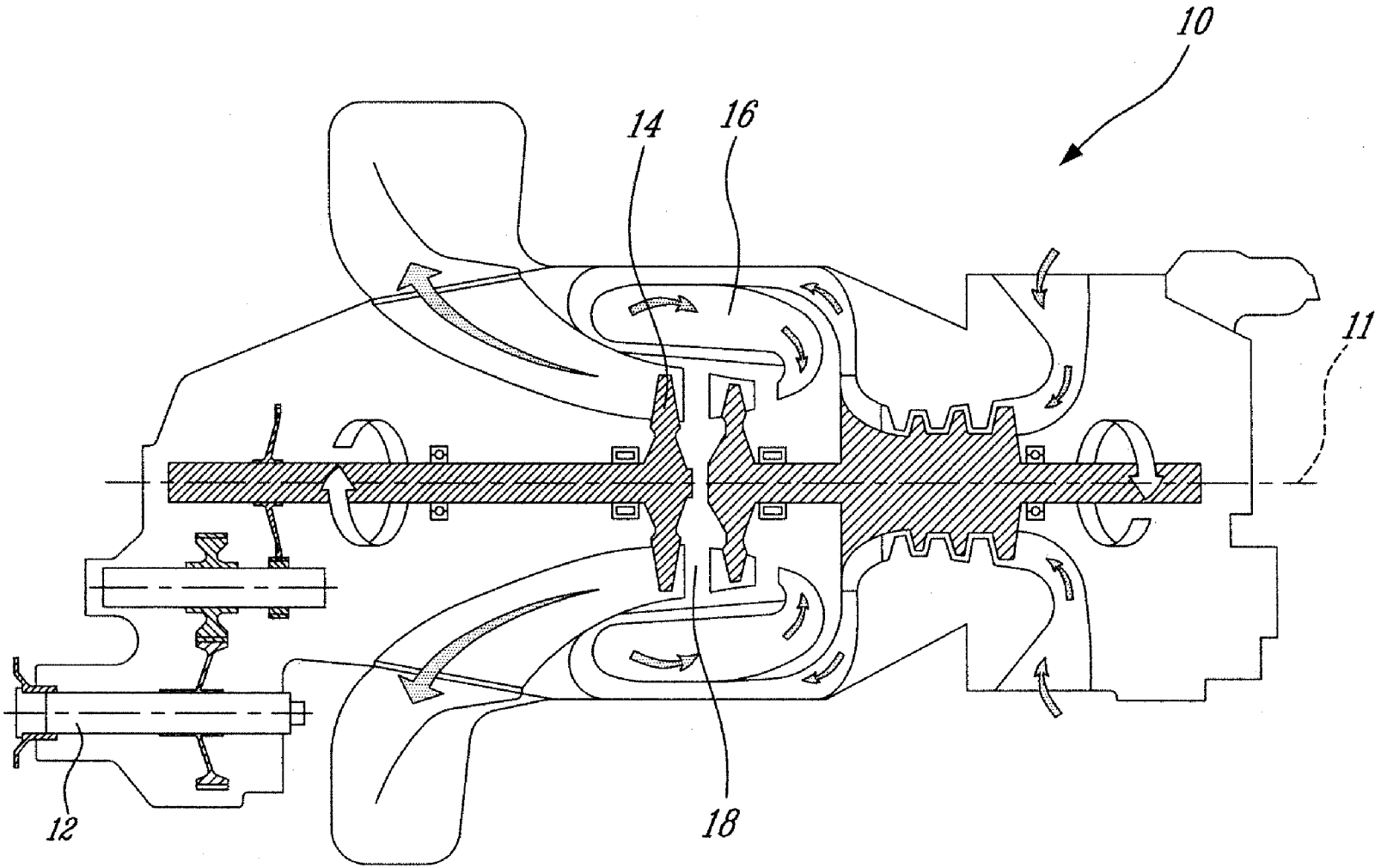
FIG. 1 is a schematic cross-sectional view of a turboshaft gas turbine engine.

FIG. 1 illustrates a turboshaft gas turbine engine 10 of a type preferably provided for use in subsonic flight, generally comprising a gear box and drive shaft 12, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
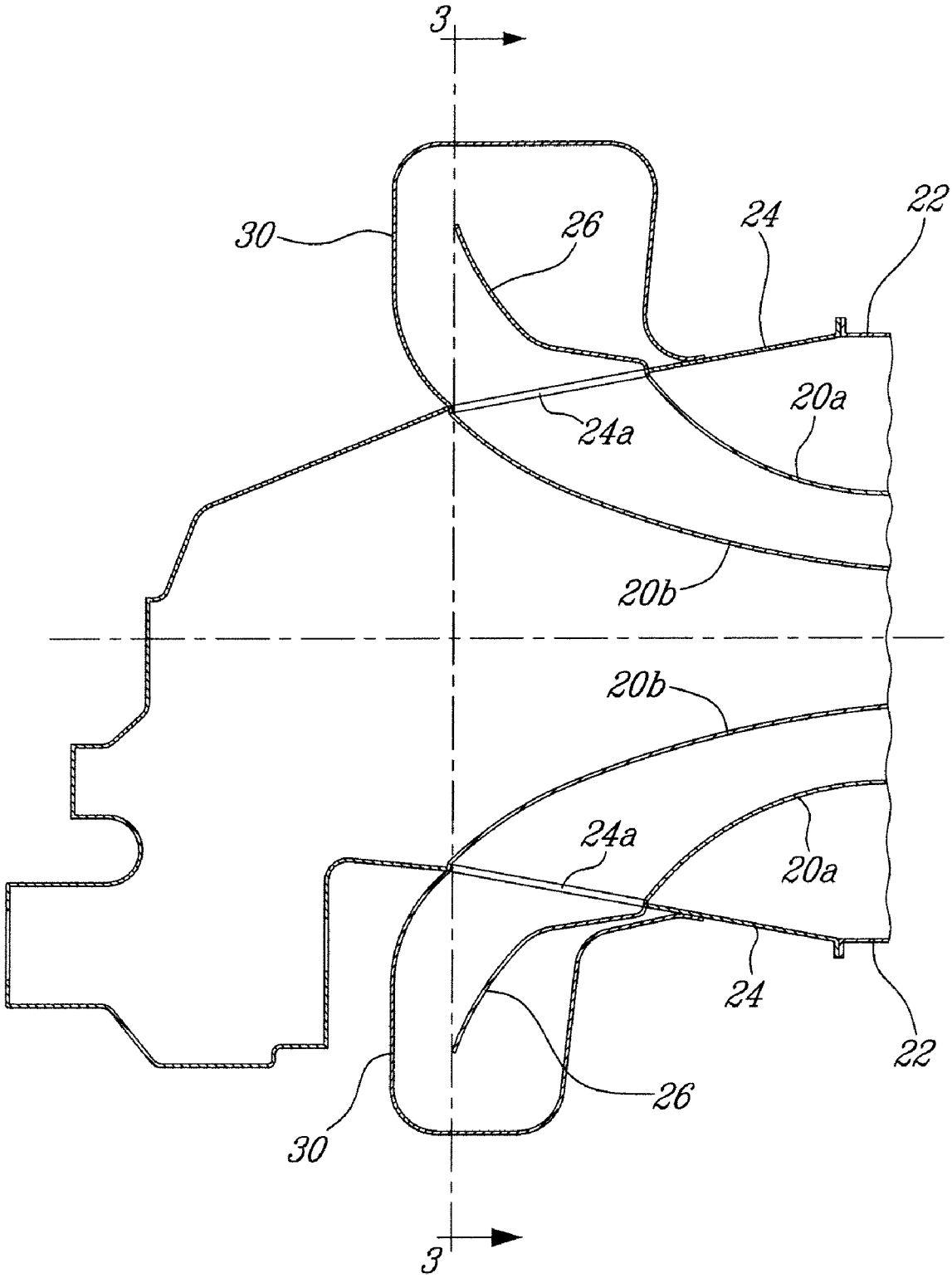
FIG. 2 is a fragmentary axial cross section of the exhaust section of the engine.

FIG. 2 shows the gas exhaust duct 20 downstream of the turbine section 18. The exhaust gas duct 20 includes concentric annular walls 20A and 20B. The exhaust gases coming off the turbine section 18 are directed along an axial component and are then directed radially outwardly. The exhaust gases are gradually diffused to reduce velocity and pressure.

As shown in FIG. 2 the engine case 22 includes the exhaust case 24 which is slotted at 24A. A plenum 28 is separately mounted on the exhaust case 24 and is in the shape of a convex annulus or torus surrounding an enclosing the slotted portion 24A of the exhaust case 24.

Figure 3:
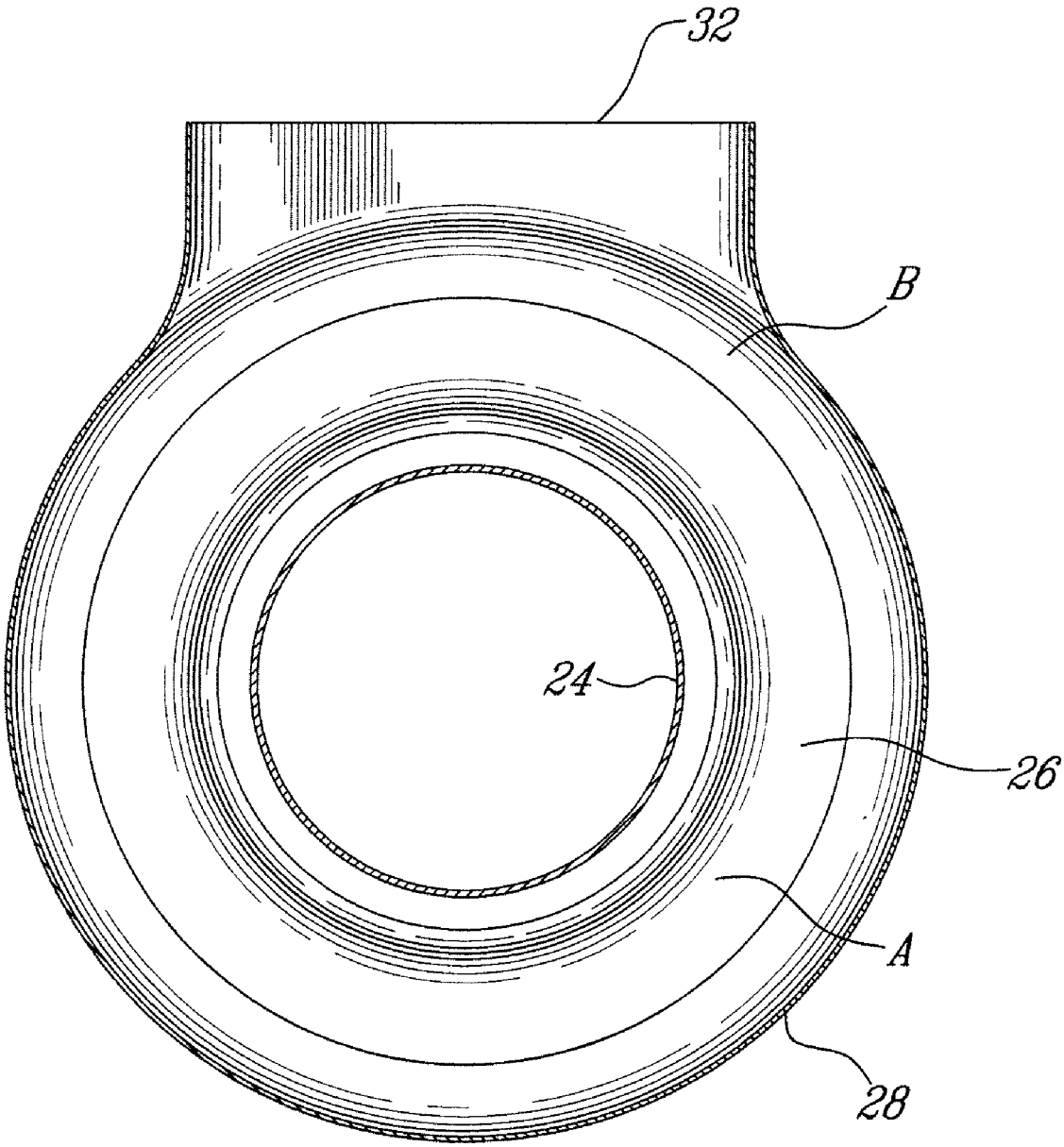
FIG. 3 is a radial cross section taken along lines 3-3 at FIG. 2.
Figure 4:
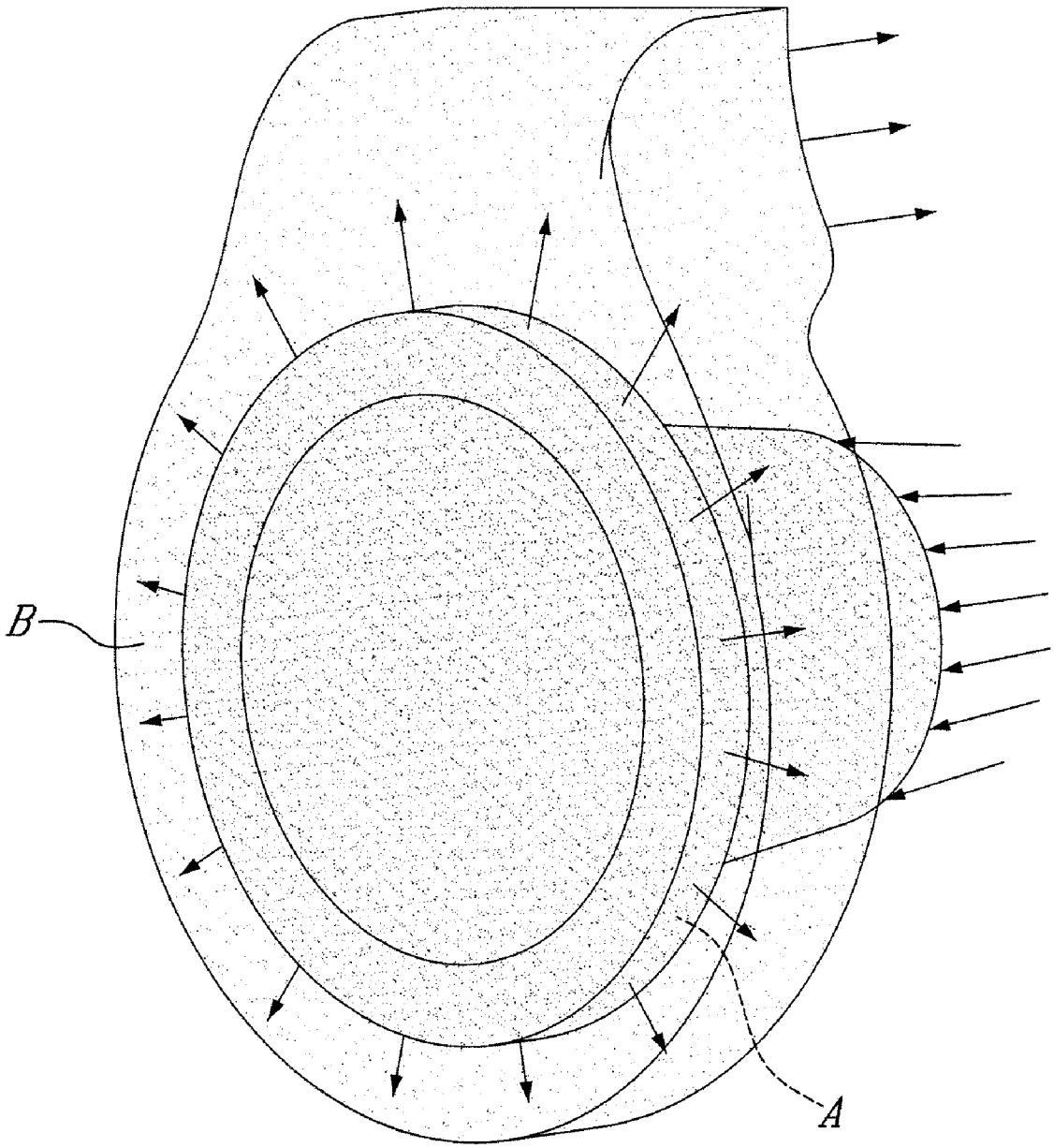
FIG. 4 is a schematic representation of the exhaust gas path taken from an angle downstream of the exhaust path.
Figure 5:
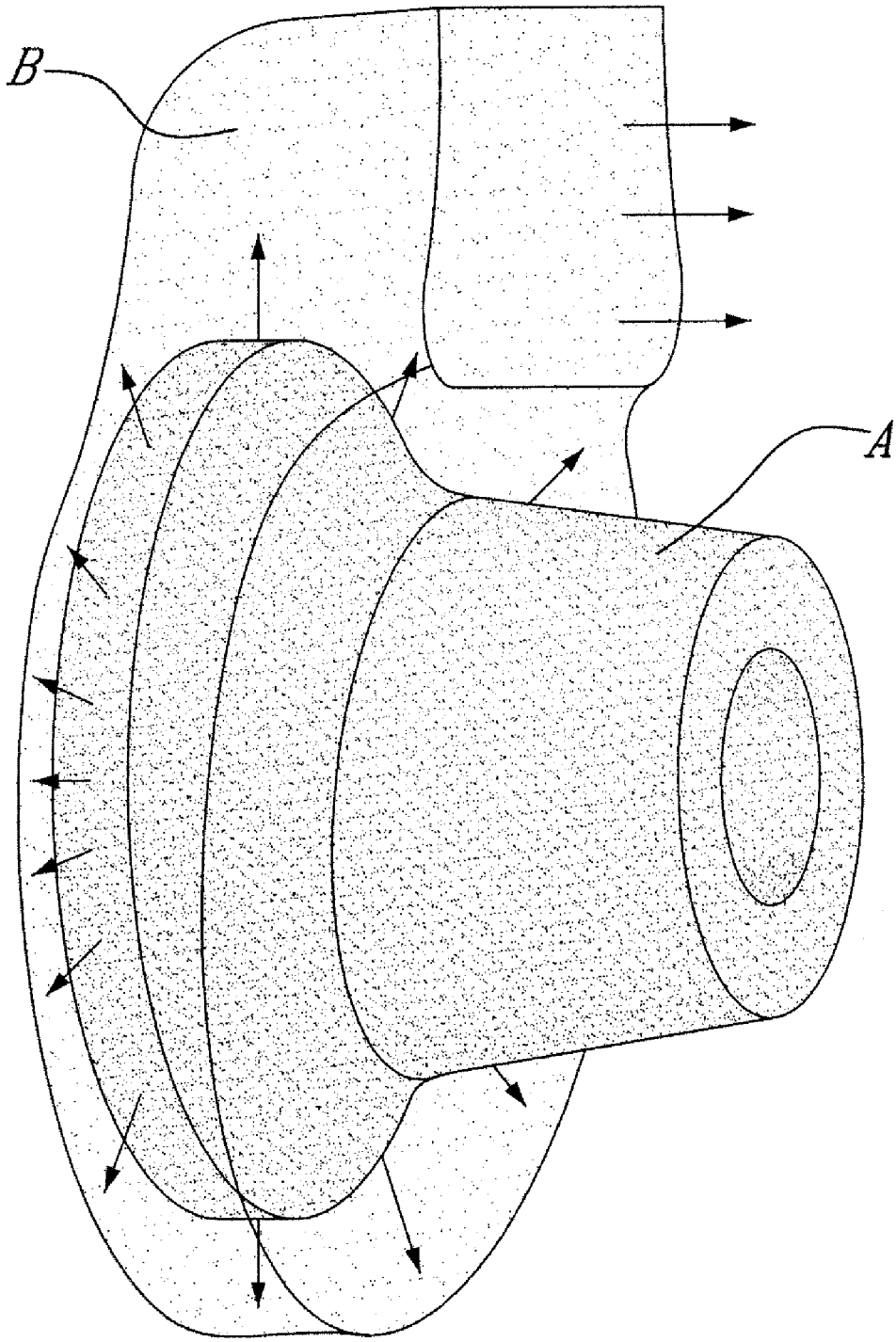
FIG. 5 is a schematic view of the gas path similar to FIG. 4 but taken at an angle upstream of the exhaust gas path.

As shown in the cross section of FIG. 3, an outlet 32 extends from the plenum 28. This outlet 32 can be on the top outermost surface of the plenum or could be on a side wall such as wall 30. As shown in FIGS. 4 and 5, the outlet 32 can be oriented to discharge the exhaust gases axially rearwardly relative to the engine central axis. As shown in FIG. 2, the outlet 32 can be provided in the form of restricted neck portion projecting radially outwardly from one side of the annulus defined by the wall of the plenum 28. As can be appreciated from FIGS. 4 and 5, the next can project axially rearwardly along a predetermined distance to thereby allow the exhaust gases to further continue their expansion path somewhat after exiting the case 24. As can be appreciated from FIG. 2, the neck portion defined by the outlet 32 confers a light-bulb or pear shaped to the plenum 28. The neck portion contributes to increase the exhaust gaspath, thereby improving diffusion.

Within the plenum 28 there is provided a wall extension 26 mounted to the exhaust case 24. The wall extension 26 has an overall concave frusto-conical shape. The wall extension 26 along with wall 30 of the plenum 28 form an extended annular exhaust duct 25 to provide the desired additional exhaust gas path which will allow significant diffusion of the exhaust gases before exiting the collection plenum 28. Reduced energy losses are obtained by so increasing the flow area and having longer exhaust diffusion. As an additional benefit, the overall thermal consistency is improved which contributes in reducing misalignment between the engine structures containing the engine rotors.

FIGS. 4 and 5 schematically show the exhaust gases as they flow through the exhaust duct 20, the extended exhaust duct 25 and into the plenum 28. The darker portion of the exhaust gas identified as A shows the higher pressure gas flow as it is being diffused. The exhaust gas portion B shows the lower pressure gases collected within the plenum 28 before being exhausted through the outlet 32.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

What is claimed is:

1. A turboshaft engine including an annular engine case with at least an exhaust gas duct having an axial component and a substantially radial component projecting at least partly beyond the engine case and defining an outer portion and a collector plenum with an outlet surrounding the radial component of the exhaust gas duct, the collector plenum having a generally convex annular shape and a diameter larger than that of the engine case; the outer portion of the exhaust gas duct extending into the plenum beyond the diameter of the engine case to extend the effective exhaust gas path outside of the engine case.

2. The engine as defined in claim 1 wherein the outer portion of the exhaust gas duct having the radial component is annular and communicates with the collector plenum.

3. The engine as defined in claim 1 wherein the engine case includes a slotted exhaust case, and wherein an inner portion of exhaust gas duct including the axial component terminates at the slotted exhaust case, the outer portion of the exhaust gas duct with the substantially radial component including a flared annular frusto conical wall extending beyond the slotted exhaust case, within the annular plenum to form an extended annular duct with the plenum wall.

4. The engine as defined in claim 1, wherein the plenum has a pear-like shape including a restricted neck portion leading to said outlet.

5. A method of diffusing the exhaust gases of a turboshaft gas engine with an annular engine case, including the steps of: a) passing the exhaust gases through an exhaust duct having an axial component and a radial component, an outer portion of the exhaust duct having the radial component being annular, b) extending the exhaust gas path by projecting the exhaust duct in its radial component beyond the engine casing in order to allow gradual diffusion of the exhaust gases, and c) collecting the diffused exhaust gases in a plenum with an outlet, the plenum having a convex annular shape and a diameter larger than that of the engine case, the outer portion of the exhaust duct extending into the plenum beyond an outer diameter of the engine case.

6. The method defined in claim 5, wherein step b) comprises mounting an annular wall extension on an outer surface of an exhaust case of the turboshaft, the annular wall extension projecting outwardly of said annular engine case into the annular plenum.

7. The method defined in claim 5, wherein step c) comprises removably mounting the annular plenum outside of the annular engine case around an exit of said exhaust duct.

* * * * *